US008215756B2

(12) United States Patent
Achhammer

(10) Patent No.: US 8,215,756 B2
(45) Date of Patent: Jul. 10, 2012

(54) LABELLING MACHINE

(75) Inventor: Karl-Heinz Achhammer, Wörth/Donau (DE)

(73) Assignee: Krones AG, Neutraubling (DE)

( * ) Notice: Subject to any disclaimer, the term of this patent is extended or adjusted under 35 U.S.C. 154(b) by 772 days.

(21) Appl. No.: 12/277,806

(22) Filed: Nov. 25, 2008

(65) Prior Publication Data

US 2009/0160901 A1 Jun. 25, 2009

(30) Foreign Application Priority Data

Dec. 19, 2007 (DE) ..... 10 2007 061 277

(51) Int. Cl.
*B41J 2/18* (2006.01)

(52) U.S. Cl. ..... 347/89

(58) Field of Classification Search ..... 347/89, 347/20–29, 30–36

See application file for complete search history.

(56) References Cited

U.S. PATENT DOCUMENTS

| | | | |
|---|---|---|---|
| 4,413,265 | A | 11/1983 | Kockler et al. |
| 6,273,545 | B1 | 8/2001 | Oide |
| 2006/0066697 | A1 | 3/2006 | Inoue |
| 2006/0244799 | A1 | 11/2006 | Sasa et al. |
| 2007/0157576 | A1 | 7/2007 | Till |

FOREIGN PATENT DOCUMENTS

| | | |
|---|---|---|
| DE | 69506146 | 5/1999 |
| DE | 102006004477 | 8/2007 |
| DE | 602004003416 | 9/2007 |
| EP | 1806291 | 7/2007 |
| JP | 09076527 A | 3/1997 |
| JP | 2004074605 | 3/2007 |

OTHER PUBLICATIONS

European Search Report for EP 08020855 mailed Mar. 31, 2009.
German Search Report for 10 2007 061 277.1 dated Jul. 10, 2008.

*Primary Examiner* — Kristal Feggins
(74) *Attorney, Agent, or Firm* — Marshall, Gerstein & Borun LLP

(57) ABSTRACT

A labelling machine and a method of applying information onto containers and/or labels by means of an ink jet printer which has at least one print head with at least one nozzle and in the case of which a cover can selectively be moved to a position in front of the discharge opening of the nozzle so as to recirculate ink discharged from the nozzle into the ink circuit. The printer can also be operated during a printing pause whereby the ink is prevented from drying up in the print head.

8 Claims, 4 Drawing Sheets

LABELLING MACHINE

CROSS-REFERENCE TO RELATED APPLICATION

The present application claims the benefit of priority of German Patent Application No. 102007061277.1, filed Dec. 19, 2007. The entire text of the priority application is incorporated herein by reference in its entirety.

FIELD OF THE DISCLOSURE

The present disclosure relates to a labelling machine for applying information onto containers by means of an ink jet printer having at least one print head with at least one nozzle.

BACKGROUND

In the recent past, it has become known to use, for the purpose of labelling containers, labelling machines comprising ink jet printers which are able to apply information onto a label, or onto a container by direct printing. Normally, printers having a demand-dependent ink jet, so-called "drop-on-demand" printers, are preferably used for this purpose. Since the ink droplets discharged from the nozzles of this type of printers are only those which are actually required for printing, this kind of printer is much more economical than the so-called "continuous-ink" printer in which an ink jet is continuously discharged from the nozzles.

A problem which is characteristic of demand-dependent printers is, however, that the ink in the print head may dry up when the print head is not in use, e.g. when the labelling machine stands still due to a change of shifts or due to some malfunction. Malfunctions may also be caused by a machine which is located upstream or downstream of a labelling machine incorporated in a line. The cleaning or the exchange of the dried-up print head leads to an additional uneconomical downtime.

SUMMARY OF THE DISCLOSURE

It is therefore the object of the present disclosure to provide an economical labelling machine in the case of which printing can be continued immediately and reliably after a time of nonuse or a malfunction of the labelling machine.

According to the present disclosure, this object is achieved by a cover which is selectively movable to a position in front of the discharge opening of the nozzle and which recirculates ink discharged from the nozzle into the ink circuit. The problem is also solved by a method in the case of which the ink jet printer is continued to be operated when the printing process is interrupted, and the ink discharged from the nozzle is recirculated into the ink circuit.

Hence, the discharge of ink can be continued even during a printing pause. A standstill of the ink and a resultant drying up of the ink is avoided in this way.

It will be advantageous when the ink jet printer is a demand-dependent printer. This allows the labelling machine to be operated at a particularly low cost.

According to a particularly advantageous embodiment, the ink jet printer can comprise at least two print heads. In addition, the cover can be subdivided such that it recirculates the ink into the ink circuit separately for each individual print head.

It is thus possible to recover inks from a plurality of print heads with the aid of a common cover and without an undesirable mixing of the individual colours.

According to an advantageous embodiment, the direction of the ink jet can remain unchanged when the cover is inserted. The amount of ink consumed can be minimized in this way.

BRIEF DESCRIPTION OF THE DRAWINGS

A preferred embodiment of the present disclosure is shown in the drawings and will be explained hereinbelow.

DETAILED DESCRIPTION OF THE PREFERRED EMBODIMENT

Figure 1:
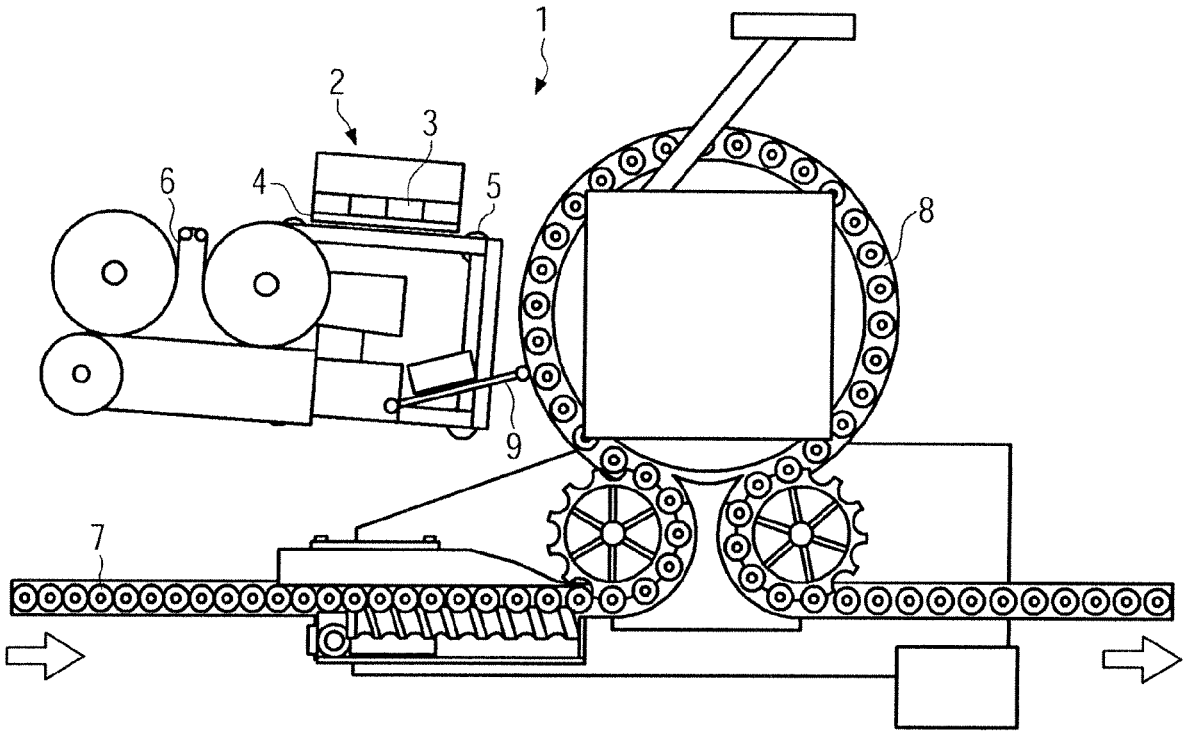
FIG. 1 shows a schematic top view of a labelling machine according to the present disclosure.

The modular labelling machine 1 shown in FIG. 1 comprises, in addition to the known basic construction, an ink jet printer 2 provided with one or a plurality of, e.g. four print heads 3 and a cover 4 which is movable to a position between the print heads 3 and a strip of labels 6 guided across the rolls 5.

In the example shown, the labelling machine 1 is configured as a rotary labeller, but it may also be configured as an inline labeller. As can be seen from FIG. 1, the containers 7 are fed via a bottle table 8 and labelled with the aid of a dispenser unit 9. It is, however, also possible to configure the labelling machine I for direct printing. In this case, the containers 7, instead of the strip of labels 6, are positioned in front of the print heads 3, i.e. the print heads are then oriented such that they face the bottle table. In this respect, it is of decisive importance that the cover 4 can be introduced between the print heads 3 and the container 7 to be labelled. The term "labelling" should in this context be interpreted either such that the respective information is first printed onto a label which is then glued onto the container 7, or such that the information is printed directly onto the container 7 or onto a possibly blank label which has already been fixed to the container 7. The labels can be provided not only as individual labels but also in the form of a roll.

Figure 2:
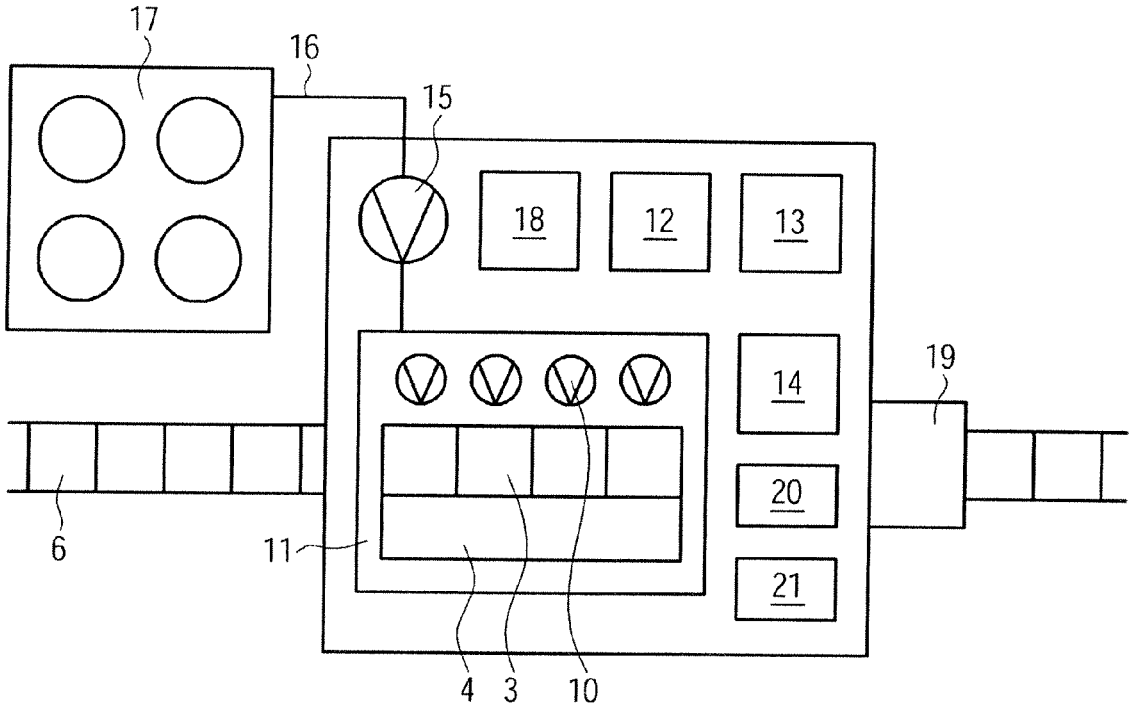
FIG. 2 shows a survey of the components of the ink jet printer according to the present disclosure.

FIG. 2 shows the components of the ink jet printer 2, which, as is usually the case, comprises a print head module 11 with print heads 3 as well as a base station 12 for controlling the print heads 3, an operating unit 13, a current supply 14, an ink supply pump 15 connected via the supply line 16 to the ink tanks 17 and the print heads 3, an ink waste container 18 and an ink drying system 19, e.g. on the basis of UV light. The printer 2 according to the present disclosure comprises, in addition to the cover 4, also circulation pumps 10, a motor 20 for driving the cover 4 as well as a control 21 for controlling the motor 20.

The control 21 accesses the motor 20 automatically when the printing process is interrupted, so that the cover 4 will be moved to a position between the print heads 3 and the strip of labels 6. To this end, the control 21 can be coupled to a suitable monitoring device of the labelling machine 1 which e.g. discerns whether the strip of labels 6 is fed. The cover 4 may, however, also be controlled through the operating unit 13.

Figure 3A:
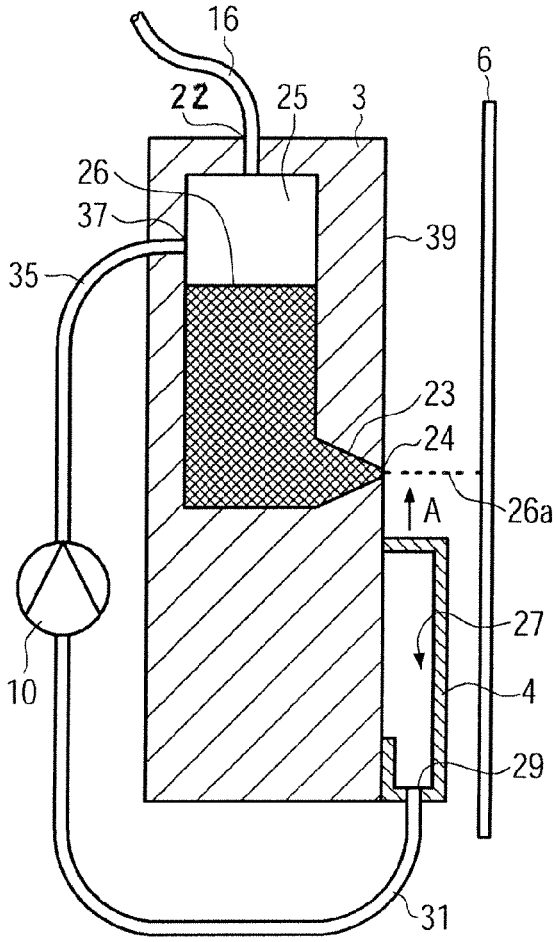
FIG. 3A shows a schematic sectional view of a print head and of the cover according to the present disclosure in the printing mode.

The structural design of the cover 4 and its position relative to the print heads 3 is illustrated by FIG. 3A, which shows exemplarily a print head 3 and a cover 4 at a printing position. The print head 3 comprises a nozzle 23 with a discharge opening 24 as well as an ink chamber 25 which is partially filled with ink 26 in FIG. 3A. An ink jet 26*a* is discharged from the discharge opening 24 and impinges on the strip of labels 6. The supply line 16 is connected to a first inlet opening 22 of the supply chamber 25.

The cover 4 is positioned on the print head side 39 facing the strip of labels 6 and it comprises an ink collection area 27 which is open towards said side 39 as well as an outlet opening 29 arranged at the lower end of said collection area 27. Said outlet opening 29 is connected to a second inlet opening 37 of the ink chamber 25 via the suction-side hose 31, the circulation pump 10 and the pressure-side hose 35.

Figure 3B:
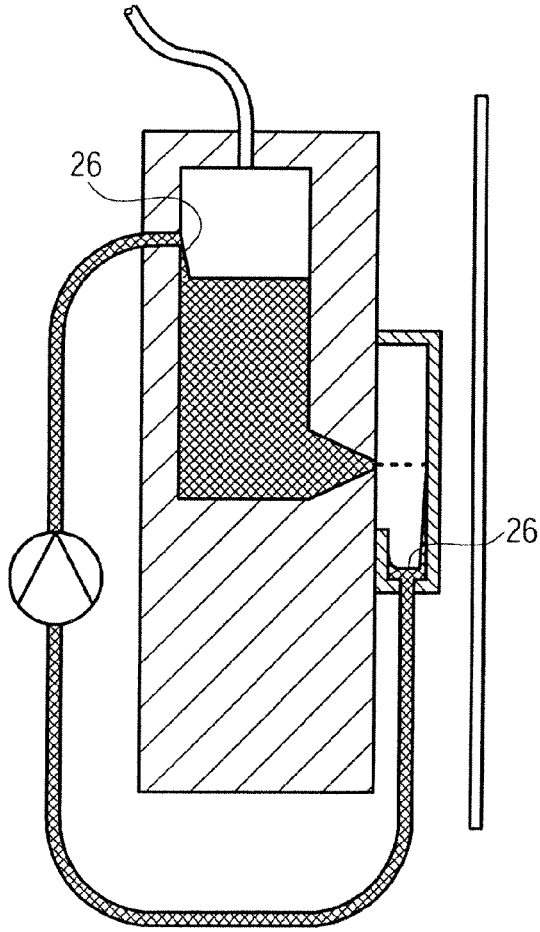
FIG. 3B shows a schematic sectional view of a print head according to the present disclosure in the circulation mode.

FIG. 3B shows the otherwise identical arrangement according to FIG. 3A at a circulation position obtained by displacing the cover 4 in the direction of the arrow A. At the circulation position, the cover 4 is arranged between the discharge opening 24 of the nozzle 23 and the strip of labels 6 so that the ink jet 26*a* is collected by the collection area 27. The collection area 27 is implemented such that ink 26 is collected above the outlet opening 29. The circulation pump 10 conveys the collected ink 26 through the outlet opening 29 and the hoses 31, 35 back into the ink chamber 25.

The print head 3 works according to requirements in accordance with the so-called "drop on demand" principle. According to this principle, the repeated change of shape of a piezo crystal (not shown) or the formation of vapour bubbles (not shown) presses ink 26 through the nozzle 23. This results in the formation of the jet 26*a* which consists of individual ink droplets, said jet 26*a* having a substantially uniform direction, and this direction is in particular independent of the position of the cover 4.

A print head 3 can comprise a plurality of nozzles 23 which are arranged e.g. in line with one another. The number of print heads 3 is not limited to the embodiment, but an arbitrary number of print heads (e.g. for multicolor printing) can be arranged in one or in a plurality of print head modules 11.

Figure 4:
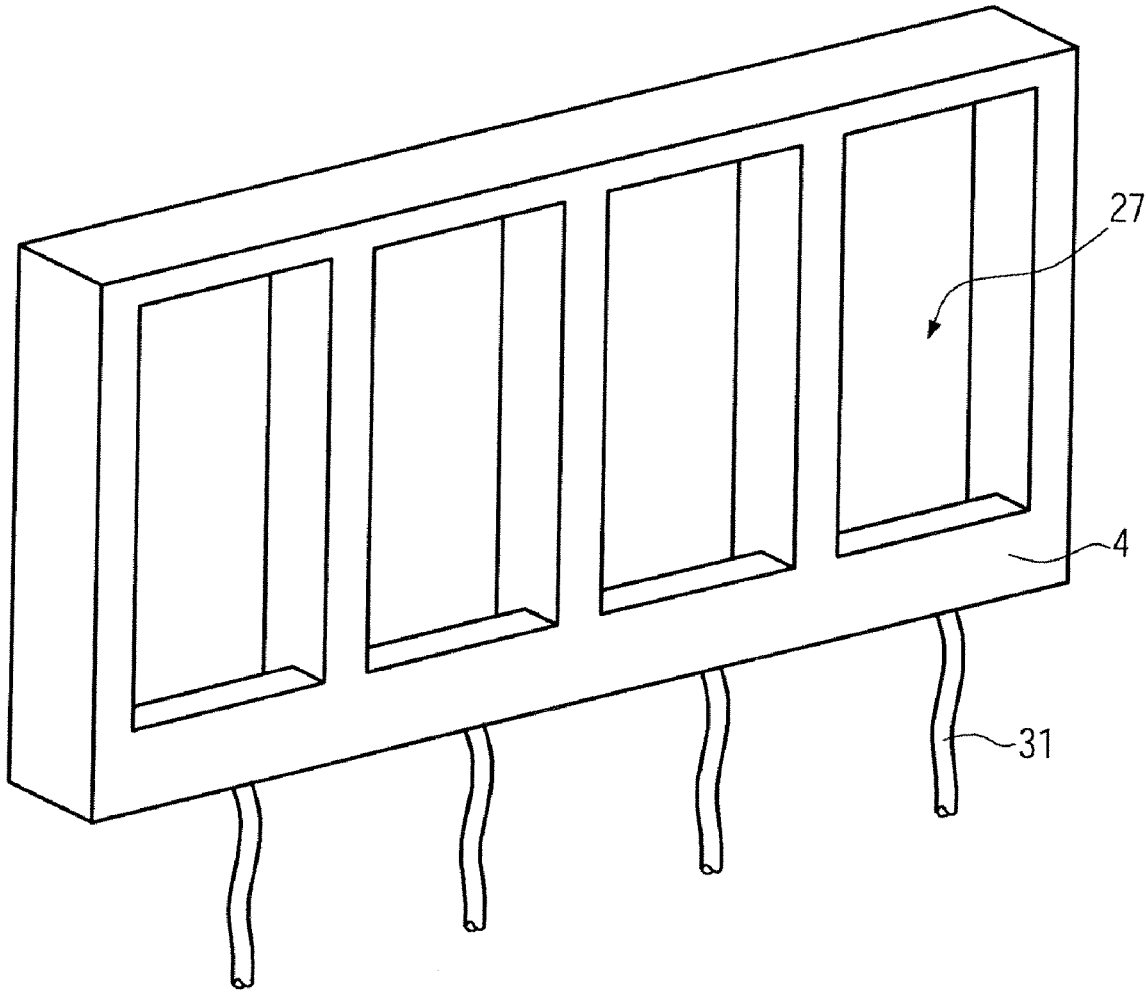
FIG. 4 shows a schematic oblique view of a cover according to the present disclosure used for a plurality of print heads.

The cover 4 consists e.g. of metal or of plastic material and is provided with a separate collection area 27 for each print head 3. A cover 4 which matches with a combination of four print heads 3 is exemplarily shown in FIG. 4. The collection areas 27 are here arranged and dimensioned such that, at the circulation position, the individual ink jets 26*a* are fully collected by the respective associated collection area 27. It is, however, also possible that a collection area 27 has associated therewith a plurality of print heads 3, e.g. in cases where the same ink is used in a plurality of print heads 3. The collection areas 27 can be formed e.g. by recesses in the cover 4 or they can be separated from one another by webs.

Making use of e.g. a sealing means which is not shown, the cover 4 fits onto the print heads 3 in a splashproof or airtight fashion so that the nozzles 23 are additionally protected against drying up. The cover may, selectively, also close a suitable opening in the housing of the print head module 11 so that the print heads 3 are sealed from the surroundings without the cover 4 being in direct contact with the print heads 3. It is also imaginable to attach the cover to a separate frame with suitable guide means. It is of decisive importance that the cover 4 can be moved to a position between the nozzles 23 and the print medium. Under certain conditions, a tight closure of the print heads 3 can also be dispensed with completely, so that the ink 26 will only be collected in the collection areas 27 and recirculated into the ink circuit.

The circulation pump 10 is a self-priming pump, such as a diaphragm pump or a hose pump. Normally, one recirculating circuit is needed per type of ink. The pressure-side conduit 35 need not necessarily end in the supply chamber 25. It is also possible to recirculate the ink into the ink tanks 17. The circulation pump 10 is preferably integrated in the print head module 11, but it may also be arranged outside the print head module 11. The circulation pump 10 may e.g. be connected to the control 21 or to the base station 12.

In the following, a method according to the disclosure invention will be described, which is used for printing on containers in a labelling machine.

When the label printing process is interrupted, the control unit 21 receives a control signal e.g. from an external monitoring means or from the operating unit 13 of the ink jet printer 2. In response to this signal, the control unit 21 accesses the motor 20 which moves the cover 4 from the printing position to the circulation position. When the printing pause has been planned, e.g. in the case of a change of shifts, the positioning of the cover is synchronized with the supply of the strip of labels 6 and of the containers 17, respectively, so that the cover 4 will be moved to the circulation position after the last printing operation. In the case of an unscheduled interruption, caused e.g. by a defect, it will make sense to continuously monitor the feeding of print media and to send, in the case of a feed stop, a suitable control signal to the control unit 21 for automatically interrupting the printing process and for moving the cover 4 to the circulation position. When the printing pause is commenced in response to an internal control signal of the ink jet printer 2, the supply of the strip of labels 6 is to be stopped in a corresponding manner.

During the printing pause, especially when the cover 4 is at the circulation position, the print heads 3 are still operated in the printing mode so that the ink still flows through the nozzles 23. It will, however, be advantageous to reduce or interrupt, e.g. with the aid of additional control instructions of the base station 12, the ink jet 26*a* temporarily during the positioning of the cover 4 so as to guarantee that the ink jet 26*a* will be fully collected by the collection areas 27 of the cover 4 and that soiling by non-collected ink 26 will be avoided. This also applies to the change from the circulation position to the printing position.

As soon as the cover 4 has reached the circulation position, the ink discharged from the print heads 3 is collected in the cover 4, separately for each individual print head 3, and is then recirculated into the ink circuit by the circulation pumps 10. If necessary, the print heads 3 have supplied thereto special printing instructions so as to accomplish the most uniform possible discharge of ink 26 from all nozzles 23 and/or so as to adjust the amount of ink to be discharged. The circulation pumps 10 can be controlled e.g. by the control unit 21 or by the base station 12. In the last-mentioned case, the delivery rate of the circulation pumps 10 can be adapted to the amount of ink discharged by the print heads 3.

At the end of the printing pause, the cover 4 is returned back to the printing position, the strip of labels 6 is fed and the printing of labels is continued.

Making use of the ink jet printer 2 according to the present disclosure, in particular of a demand-dependent printer according to the present disclosure, and of the method according to the present disclosure, ink 26 can be discharged from the nozzles 23 and circulated even during a printing pause. This will prevent the nozzles 23 from drying up, without increasing the amount of ink consumed. The use of a common cover 4 with a plurality of collection areas 27, which are associated with the individual print heads 3, guarantees, on the basis of a low technical expenditure, a neat separation of the respective types of inks (colors) used.

I claim:

1. A labelling machine for applying information onto containers and/or labels, comprising an ink jet printer having at least one print head with at least one nozzle, a cover which is selectively movable to a position between the nozzle and at least one of a container and a label and in front of the discharge opening of the nozzle and which recirculates ink discharged from the nozzle into the ink circuit.

2. A labelling machine according to claim 1, wherein the ink jet printer is a demand-dependent printer.

3. A labelling machine according to claim 1, wherein the ink jet printer comprises at least two print heads, and that the cover is subdivided such that it recirculates the ink into the ink circuit separately for each individual print head.

4. A labelling machine according to claim 1, wherein the direction of the ink jet remains unchanged when the cover is inserted.

5. A method of applying information onto containers and/or labels in a labelling machine, comprising:

using an ink jet printer having at least one print head with at least one nozzle, continuing to operate the ink jet printer in a printer mode when the printing process is interrupted, and recirculating the ink discharged from the nozzle into the ink circuit.

6. A method according to claim 5, and discharging the ink from the nozzle in a demand-dependent manner.

7. A method according to claim 5, recirculating the ink into the ink circuit separately for each individual print head.

8. A method according to claim 5, and not changing the direction of the ink jet when the printing process is interrupted.

* * * * *